United States Patent [19]

Vinas

[11] Patent Number: 4,773,169

[45] Date of Patent: Sep. 27, 1988

[54] MACHINE FOR CONTINUOUS CENTRIFUGATION OF FABRICS

[76] Inventor: Jaime A. Vinas, Barcelona 23, 08120-La Llagosta, Spain

[21] Appl. No.: 78,689

[22] Filed: Jul. 27, 1987

[30] Foreign Application Priority Data

Jul. 30, 1986 [ES] Spain ..... 8600709

[51] Int. Cl.[4] ..... F26B 17/24

[52] U.S. Cl. ..... 34/58; 34/8; 68/19.1; 68/24

[58] Field of Search ..... 34/8, 58; 68/19.1, 24

[56] References Cited

U.S. PATENT DOCUMENTS 3,413,729 12/1968 Wagner ..... 34/58

3,908,410 9/1975 Umehara et al. ..... 68/19.1 X 4,098,004 7/1978 Rousselet ..... 34/58 X

*Primary Examiner*—Steven E. Warner

*Attorney, Agent, or Firm*—McGlew and Tuttle

[57] ABSTRACT

A machine for the continuous centrifugation of fabrics, comprising: a hauling means for the fabric formed by two endless bands having respective facing runs and an orbitting central block in which there are situated guide means for the bands, such that the latter follow cylindrical orbital paths during the passage thereof through the central block and conical orbital paths from the central block to the infeed and delivery ends of the machine. The orbital movement of the central block causes effective centrifugation of the fabric hauled by the bands, without causing therein harmful pulls or stresses.

7 Claims, 4 Drawing Sheets

MACHINE FOR CONTINUOUS CENTRIFUGATION OF FABRICS

FIELD OF THE INVENTION

The present invention relates to a machine for continuous centrifugation of fabrics, particularly for the removal of scouring, dye or other liquors.

DESCRIPTION OF THE PRIOR ART

In many fabric finishing processes, it is necessary to remove therefrom the liquors that they have absorbed. A first stage of this operation is frequently based on centrifugation of the fabric, whereby the moisture contained therein is considerably reduced, moisture levels of 50% being considered as satisfactory.

Nevertheless, the commonly known fabric centrifugation apparatus and devices have several drawbacks. In the first place, they usually operate on a batch basis, i.e., the fabric must be charged in the centrifuge, the operation must be carried out during the desirable period of time and the machine must subsequently be unloaded. This is a slow, laborious job. Furthermore, centrifuges usually twists the fabric, this being usually harmful and also requires a further operation to remove the twists that have occurred.

SUMMARY OF THE INVENTION

In view of this, it is an object of the invention to provide an orbital movement wherewith the above drawbacks do not occur.

The above object is attained by a machine of the type stated hereinbefore, comprising:

(a) a hauling means, formed by a first pair of mutually parallelly disposed end rollers; a first endless band adapted to run continuously around each roller of said pair, having a lower inoperative run and an upper operative run; a second pair of end rollers disposed parallel to each other and also to the rollers of the first pair; and a second endless band adapted to run continuously around each roller of said second pair, having an upper inoperative run and a lower operative run, such that said operative runs of each band are facing one another;

(b) a central block formed by: two equal coaxial suspended pulleys, each having at least three peripheral grooves and an eccentric circular aperture; and connecting means for rigidly connecting both pulleys together;

(c) guide means for said bands, comprising: two compound discs, each housed in one of said eccentric circular apertures and having a generally rectangular window; a bearing between each disc and the corresponding suspended pulley; two U-shaped sections extending between both compound discs, corresponding to opposite sides of said windows;

(d) support means for said central block which, for each suspended pulley, comprise a set of three support pulleys, situated generally regularly around the corresponding suspended pulley, there being at least one transmission belt between each support pulley and the corresponding suspended pulley;

(e) a motor to cause said central block to orbit;

(f) a frame surrounding the machine generally along the length thereof.

A machine of the above described nature allows a one end of a piece of fabric to be inserted in the machine in the space formed between the operative runs of each band and cross therethrough, hauled by said bands, until it exits therefrom in a continuous way. While the piece is moving through the machine, it is centrifuged therein, by the orbiting effect of the central block; said orbiting causes a corresponding cylindrical orbital movement of eccentric apertures and of the compound discs housed therein and therefore of the portion of fabric crossing through the central block and at the same time an orbital movement along a conical path of the fabric portions located between the central block and the inlet and delivery points of the fabric. Said movements, as stated above, provide for effective centrifuging without twisting the fabric piece, which is retained always between the bands.

BRIEF DESCRIPTION OF THE DRAWINGS

For a better understanding of the foregoing, there is described hereinafter a non-limitative embodiment of the machine, with reference to the accompanying drawing, in which.

DETAILED DESCRIPTION OF THE INVENTION

Figure 1:
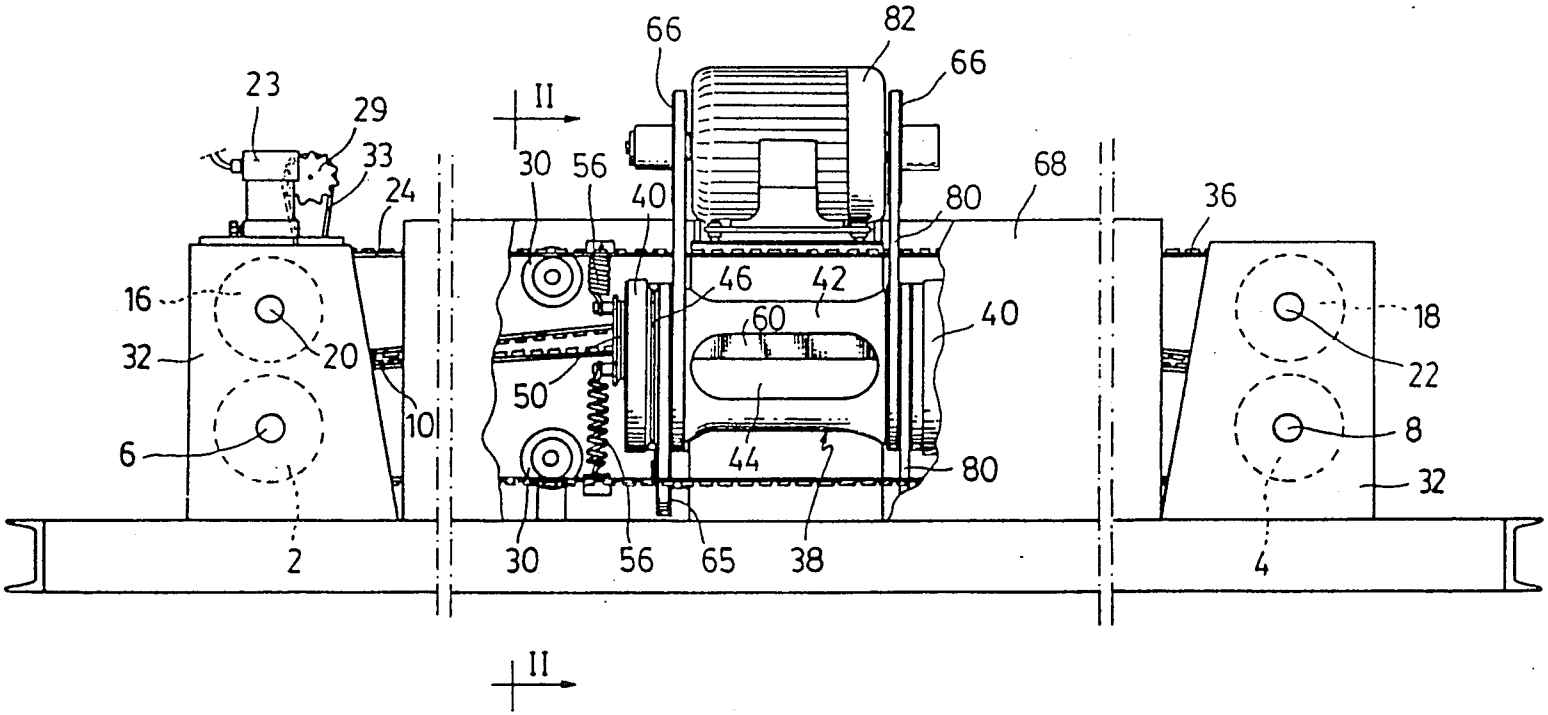
FIG. 1 is an elevation view of the machine according to the invention, with part of the outer frame broken away to reveal the central block; further portions of the machine have been omitted to avoid making the drawing excessively long.
Figure 2:
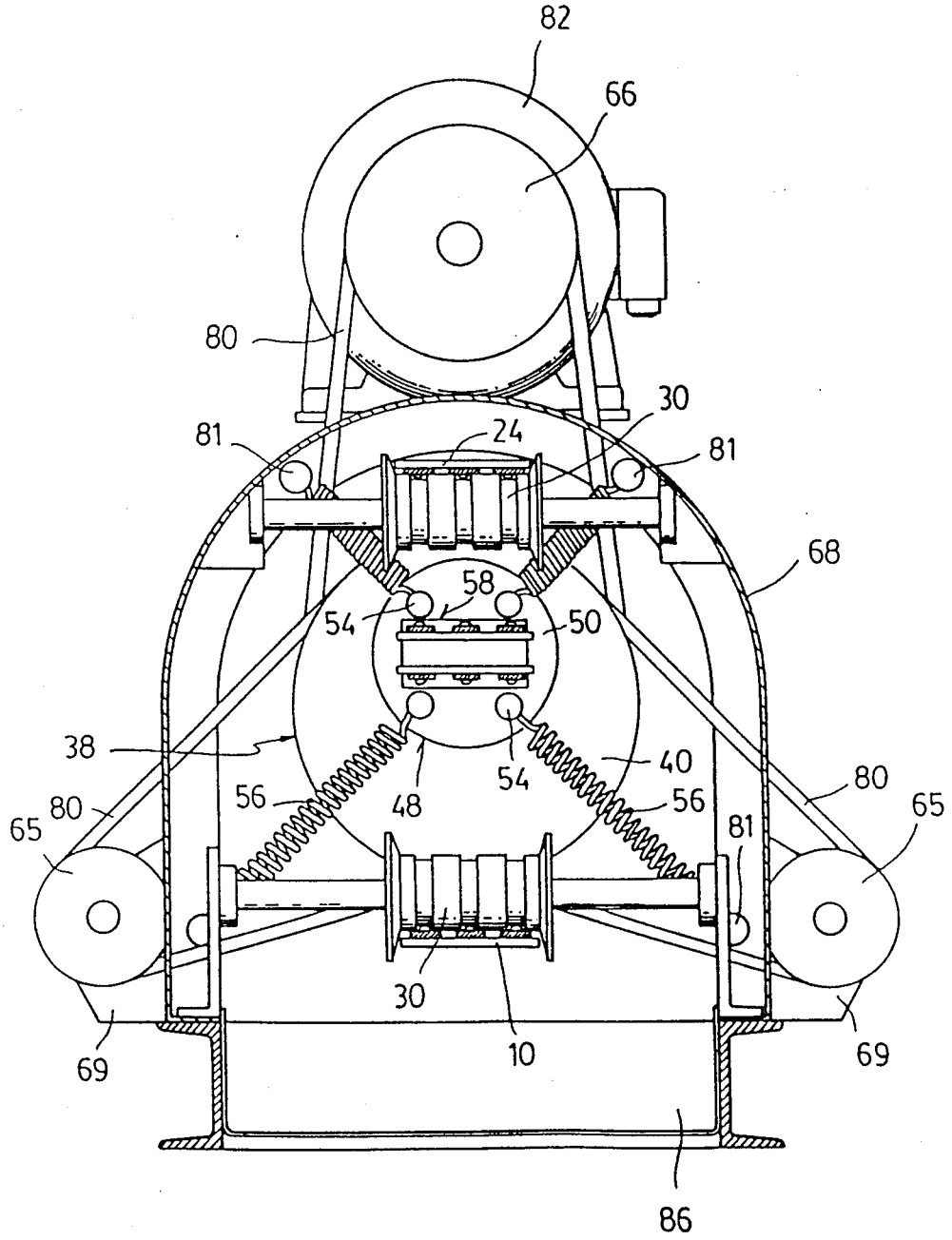
FIG. 2 is a cross section view on a larger scale, on the line II—II of FIG. 1.
Figure 3:
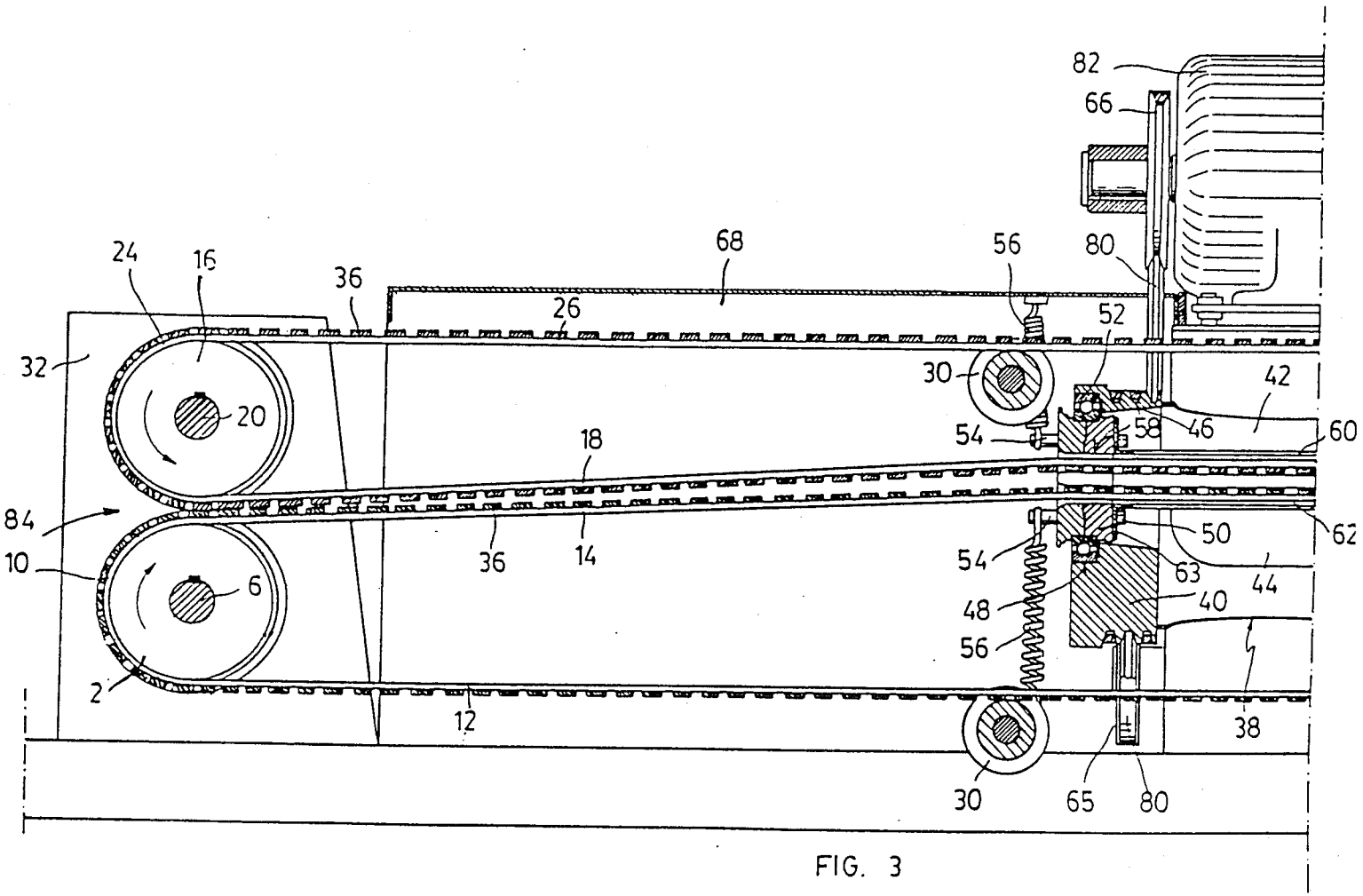
FIG. 3 is a diagrammatic longitudinal section of the machine on a smaller scale than the previous figure, showing only one half thereof, the omitted half being generally symmetrical to the one shown; the motor is not in section and the drive means of the hauling means have been omitted.
Figure 4:
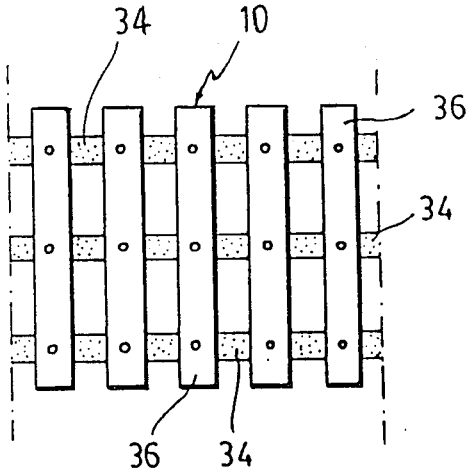
FIG. 4 is a plan view of part of the band.
Figure 5:
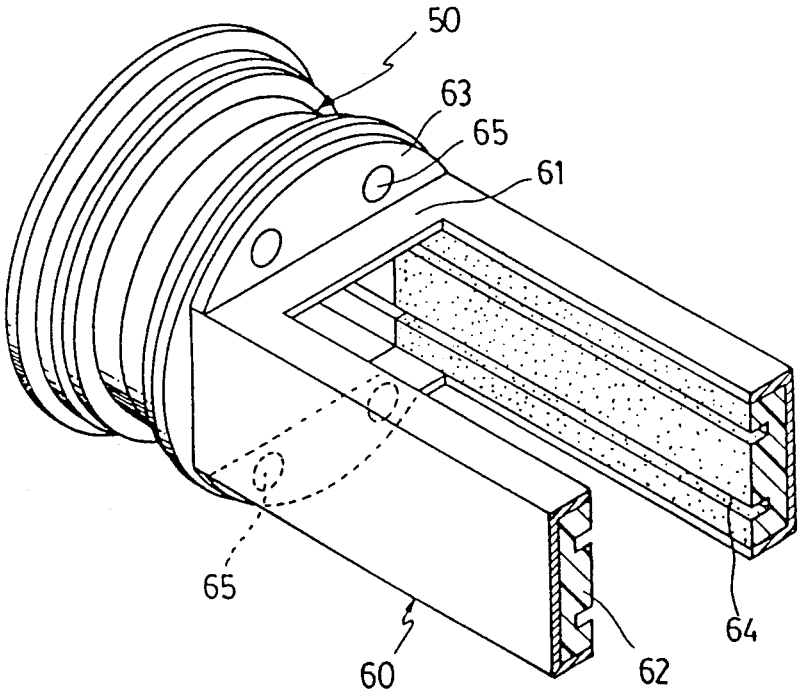
FIG. 5 is a perspective view of one of the complex discs and of the U-shaped sections, shown in cross section, extending between the two compound discs.

The machine for continuous centrifugation of fabrics is particularly appropriate for the removal of scouring, dye and other liquors.

In said machine there should be distinguished a hauling means formed by a roller 2 and a roller 4 located at opposite ends of the machine and mounted on generally parallel shafts 6 and 8. A first endless band 10 extends continuously between said first pair of rollers and partially wraps them, forming a lower inoperative run 12 and an upper operative run 14.

There is a second pair of rollers 16 and 18, the respective shafts of which 20 and 22 are mutually parallel and also parallel to the shafts 6 and 8 of the first pair of rollers. Preferably the rollers 16 and 18 are mounted respectively above rollers 2 and 4 of the first pair of rollers; at least one of the shafts 20, 22 is fixed so as to be adapted to be moved a small distance vertically, there being spring means 23, not shown in detail, urging the corresponding roller 16 and/or 18 in the closest possible engagement with the corresponding roller of the first pair.

A second endless band 24 extends continuously between the second pair of rollers 16, 18 and partly wraps them, determining an inoperative top run 26 and an operative lower run 18, such that the operative runs 14 and 18 of each band are mutually facing and spaced a short distance apart.

Drive means 29 for the said rollers cause them to rotate and this rotation causes movement of the bands 10 and 24; this movement is effected in such a way that the said operative runs 14 and 28 move generally at the same speed. Guide rollers 30 suitably engage the inoperative runs 12 and 26 of the bands.

Said drive means 29 are conventional. One possible solution is the use of a motor, not shown, driving a pinion transmitting the movement thereof synchronously to the rollers 2 and 16 by way of transmission chains 33 shown schematically in FIG. 1.

The shafts 6, 20, 8 and 22 are supported in bench frames 32, it being contemplated that there are means, not shown, provided for the shafts 20 and 22 to allow for a slight vertical movement of the shafts 20 and 22, as mentioned above.

The bands 10 and 24 are formed preferably by two or more narrow longitudinal strips 34 to which there are attached by pins or the like a plurality of cross members 36 which are disposed towards the exterior of the band.

In the center of the machine there is a central block 38 formed generally by two suspended pulleys 40 which are identical and coaxial and which are rigidly connected together by connecting means 42 having a plurality of longitudinal passages 44. Each of the pulleys is provided with at least three peripheral grooves, adapted to house belts to be described hereinafter.

As guide means for the operative runs of the bands, each pulley is provided with a circular aperture eccentrically disposed relative to the axis of the pulley and the respective apertures of each pulley are aligned parallel with the axis of the pulley.

In the aperture 48 of each suspended pulley 40 there is a compound disc 50, formed of two superimposed portions. Between the compound disc 50 and the perimeter of the aperture 48 there is a bearing 52 allowing rotation or relative angular movement between the disc and the pulley. The disc comprises the said two superimposed portions to make it possible to mount the disc and the bearing 52 in the aperture 48. The disc has crossing therethrough four rods 54, holding the said two portions together and also serving to mount springs 56 to be described hereinafter.

Each compound disc 50 is also provided with a generally rectangular window 58 and between both windows there extend two U-shaped sections 60 and each section is engaged in opposite sides of the windows 58, precisely in the sides oriented perpendicularly to the bands 10 and 24.

Said U-shaped sections are connected together by cross ties 61 and the unit is mounted to the inner surface of the compound disc 50 by circular sectors 63 which are attached to the compound disc 50 by means of the said rods 54 through orifices 65.

The operative runs 14 and 28 of the bands 10, 24, cross through the windows 58 and during the run thereof between both windows inside the central block 38, the said bands are guided by the sections 60. To facilitate this guiding action and avoid large frictional forces, the inner surface of the sections is covered by an antifriction material 62, generally a plastics material such as nylon, teflon or the like. Furthermore, it is contemplated that said covering 62 should be provided with two grooves 64, each of which is adapted to receive one end of the cross members 36.

The central block 38 is suspended by way of support means formed, for each suspended pulley, by a set of at least three support pulleys 65 and 66, situated generally regularly around the corresponding suspended pulley 40 and duly attached, directly or indirectly, to the frame 68. The lower pulleys 65 are attached to brackets 69 of the frame. Between each support pulley 66 and the corresponding suspended pulley 40 there is at least one transmission belt 80, running in the peripheral grooves 46 of the pulley 40.

The thus suspended central block 38 is adapted to rotate around the axis thereof and preferably the corresponding motor 82 is arranged coaxially with a pulley 66 of each set of pulleys, whereby these pulleys 66 have the dual support and drive function.

Each of the rods 54 of the compound disc 50, as said above, support one end of a spring 56, the other end of which is attached to the frame 68 in corresponding anchor points 81. During the orbital movement of the of the central block 38, the aperture 48 also obviously orbits and, therefore, the said compound discs 50; nevertheless, the effect of the springs 56 is that during the orbiting movement thereof all the positions of the compound discs 50 are always mutually parallel and therefore the windows 58 and sections 60 always retain the same parallel orientation relative to the bands 10 and 24. This constant orientation of the compound discs 50 causes a relative rotation between them and the corresponding suspended pulley, which rotation is facilitated by the bearing 52.

In turn the frame 68 has a generally arch shaped section and surrounds the machine over a substantial length thereof.

The rollers 2 and 16 rotate as indicated by the arrows 82, i.e. in opposite directions. With the said rotations, there is inserted in the nip 84 between the rollers 2 and 16 the end of a fabric piece (not shown), which is hauled in by the bands 10 and 24 along the whole length of the operative runs 14 and 28 of the bands, until it exits from the opposite end of the machine, i.e. the end corresponding to the rollers 4 and 18.

If the fabric piece were thicker than the spacing between the facing bands in the nip 84, the said spring means are overcome and the roller 16 moves slightly, being separated from its closest possible engagement with the roller 2.

With the fabric filling the whole space between the two bands 10 and 24, the central block is caused to orbit, whereby the portion of the fabric piece comprised between the U-shaped sections 60 follows the same cylindrical orbital movement, while the portions of the fabric comprised between the central block and the ends of the machine, orbit around a cone, all simultaneously with a forward feed of the fabric piece between the runs 14 and 28 of the bands 10 and 24.

The speed of orbital movement is adjustable and may reach up to 2,500 r.p.m. and the forward feed speed is about 20 meters per minute.

The orbital movement causes centrifugation of the fabric piece, so that the moisture level of 100 to 120% at the fabric infeed is reduced to 30 to 50% moisture level at the delivery end.

The system, as stated, is continuous and among other advantages it has the one of not twisting or winding the fabric, whereby the latter is not liable to deterioration during its passage through the machine.

The free lateral space between the bands provides for drainage of the liquors, which also flow through the free space between two consecutive cross members 36; said space is the only one allowing for passage of the liquors during the passage of the piece through the central block 38, since the side space is closed by the sections 60.

The apertures 44 of the connecting means 42 also allow for drainage of the liquors from the central block and the frame 68 prevents the centrifugally ejected liquors from dispersing undesirably; said liquors are collected at the bottom 86 of the frame, from where they may be appropriately channelled away.

What I claim is:

1. A machine for continuous centrifugation of fabrics, particularly for the removal of scouring, dye or other liquors, comprising:

(a) a hauling means, formed by a first pair of mutually parallelly disposed end rollers; a first endless band adapted to run continuously around each roller of said pair, having a lower inoperative run and an upper operative run; a second pair of end rollers disposed parallel to each other and also to the rollers of the first pair; and a second endless band adapted to run continuously around each roller of said second pair, having an upper inoperative run and a lower operative run, such that said operative runs of each belt are facing one another;

(b) a central block formed by: two equal coaxial suspended pulleys, each having at least three peripheral grooves and an eccentric circular aperture; and connecting means for rigidly connecting both pulleys together;

(c) guide means for said bands, comprising: two compound discs, each housed in one of said eccentric circular apertures and having a substantially rectangular window; a bearing between each disc and the corresponding suspended pulley; and two U-shaped sections extending between both compound discs, corresponding to opposite sides of said windows;

(d) support means for said central block which, for each suspended pulley, comprise a set of three support pulleys, situated generally regularly around the corresponding suspended pulley, there being at least one transmission belt between each support pulley and the corresponding suspended pulley;

(e) a motor to cause said central block to orbit;

(f) a frame surrounding the machine generally along the length thereof.

2. The machine of claim 1, wherein said motor is disposed coaxially with one pulley of each of the sets of suspended pulleys.

3. The machine of claim 1, being provided with a plurality of springs, each of which is attached at one end to the frame and at the other end to one of said compound discs.

4. The machine of claim 1, wherein at least one end roller of the second pair of rollers is arranged generally above one end roller of the first pair of rollers and may be moved generally vertically, there being spring means urging said roller of said second pair in a position of closest possible engagement with said roller of said first pair.

5. The machine of claim 1, wherein each of said bands is formed by at least two longitudinal strips and by a plurality of cross members.

6. The machine of claim 5, wherein the U-shaped sections are provided with an internal covering of antifriction material, in which there are two longitudinal grooves receiving said cross members.

7. The machine of claim 6, wherein said antifriction material is teflon or nylon.

* * * * *